United States Patent [19]

Corrigan

[11] 4,248,436

[45] Feb. 3, 1981

[54] BUBBLE TARGET AMUSEMENT DEVICE

[76] Inventor: Malcolm J. Corrigan, P.O. Box 167, Southhampton, N.Y. 11968

[21] Appl. No.: 68,362

[22] Filed: Aug. 21, 1979

[51] Int. Cl.[3] ..... A63F 9/02

[52] U.S. Cl. ..... 273/349; 46/6; 273/356; 273/380

[58] Field of Search ..... 273/349, 355, 356, 362, 273/380; 46/6, 7, 8

[56] References Cited

U.S. PATENT DOCUMENTS

| | | | |
|---|---|---|---|
| 2,225,702 | 12/1940 | Lyon | 46/8 |
| 2,409,471 | 10/1946 | Brosseit | 46/6 X |
| 2,832,173 | 4/1958 | Winfield | 273/349 |
| 3,434,717 | 3/1969 | Schwartz | 273/349 |
| 4,128,966 | 12/1978 | Spector | 273/349 X |

*Primary Examiner*—Anton O. Oechsle

*Attorney, Agent, or Firm*—Sughrue, Rothwell, Mion, Zinn and Macpeak

[57] ABSTRACT

An amusement device has a supporting base with a central division wall. The division wall has an opening therein over which a simulated aircraft with bomb bay door or the like is disposed, and a housing is positioned behind the opening. A bubble pipe is disposed behind the simulated aircraft with its bowl inverted so that bubbles emitted therefrom appear to originate in the aircraft bomb bay. A tube is connected operatively to the bubble pipe, and has an end extending to the operators' position on the supporting base. At such position, a water pistol is mounted on a bracket, so that a water stream directed therefrom may be employed to attempt to strike the bubble. A catch is positioned on the supporting base below the opening and within the housing wherein expended fluid is collected for disposal or for re-use. Side flanges on the housing aid in the prevention of spillage.

6 Claims, 3 Drawing Figures

BUBBLE TARGET AMUSEMENT DEVICE

BACKGROUND OF THE INVENTION

1. Field of the Invention

This invention pertains to amusement devices, and more particularly, to amusement devices of the type wherein a stream of water is propelled at a target.

2. Statement of the Prior Art

Amusement devices in which a stream of water is directed toward a bubble target have been previously proposed. Patents issued in this field include the below listed prior U.S. patents:

| Patentee | U.S. Pat. No. | Issue Date |
|---|---|---|
| D. Greenwalt | 216,176 | June 3, 1879 |
| 0. D. Munn | 1,507,505 | Sept. 2, 1924 |
| P. S. Gilchrist, Jr. | 2,393,039 | Jan. 15, 1946 |
| M. A. Brosseit | 2,409,471 | Oct. 15, 1946 |
| D. E. Winfield | 2,832,173 | April 29, 1958 |
| C. Cashavelly et al | 3,399,485 | Sept. 3, 1968 |

SUMMARY OF THE INVENTION

The invention herein disclosed is intended to provide a unique and interesting apparatus in the nature of a renewable target against which a fluid stream is directed. The device provides training in manipulative skills for young people, and also is entertaining to persons of all ages.

The device includes a base and a wall, with a bubble forming device mounted in the wall such that bubbles produced thereby provide a target area. A water pistol is adapted to project a fluid stream toward the bubble area, and when the stream is successfully directed so that it contacts the bubble, the bubble is burst. Below the bubble target, the base is provided with a collector tray to avoid damage to the base by the liquid and to permit re-use of the liquid. At least that portion of the base forward of the wall has side flanges to avoid liquid spillage.

The target area may include a representation of an aircraft with a bomb bay, and the bubble forming device is placed behind this so that the bubble simulates a bomb emerging from the bomb bay. A tube extends from the bubble device, and may be blown into by the user to form the bubbles. If the user is smoking tabocco products, the smoke therefrom may be used to produce the bubbles, and in that event, a successful impingement of the stream against the bubble results in release of the smoke enhancing the entertainment value of the unit.

The invention is of uncomplicated and economical construction and assembly.

Other and further objects and advantages of the invention will become apparent to those skilled in the art from a consideration of the following specification when read in conjunction with the annexed drawing.

DESCRIPTION OF THE PREFERRED EMBODIMENT

Figure 1:
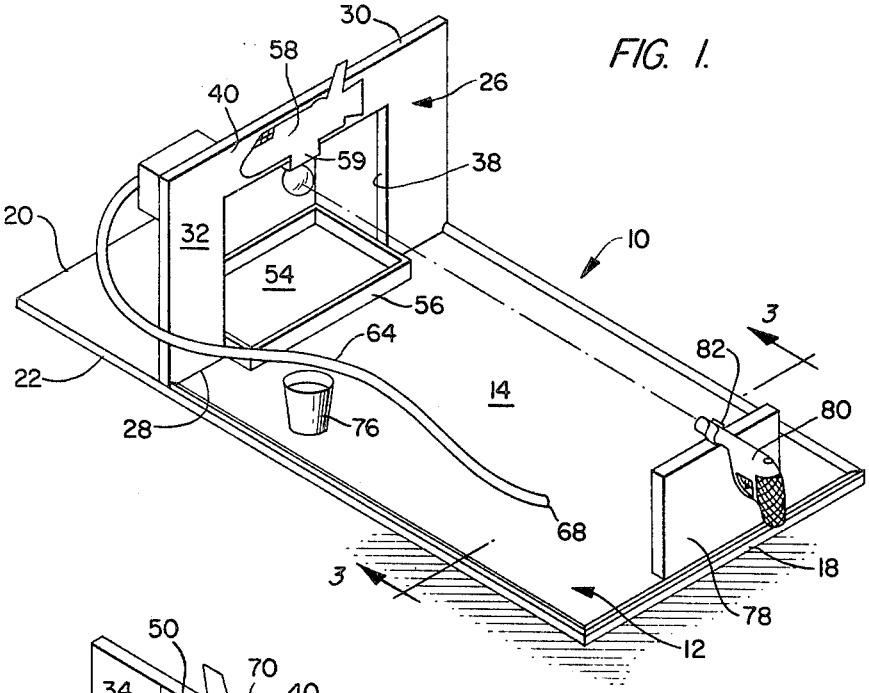
FIG. 1 is a frontal perspective view showing an amusement device constructed and assembled in accordance with this invention.

Referring to the drawing in more detail, the invention hereof is generally designated therein by reference character 10, and includes as a main structural component thereof a flat, substantially rectangular supporting base 12. The base has an upper surface 14, lower surface 16, front and back edges 18, 20, and sides 22 and 24. Extending upwardly about the periphery of the front edge 18 and a portion of the side edges 22 and 24 is a flange 25.

Figure 3:
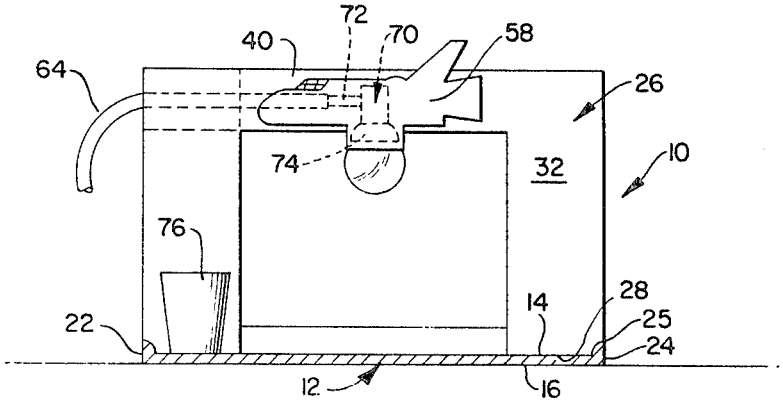
FIG. 3 is a fragmentary, enlarged sectional view taken on line 3—3 of FIG. 1, looking in the direction of the arrows.

The flange 25 terminates at a vertically oriented division wall 26 which is fixedly secured to the supporting base 12, and extends from the upper surface 14 thereof. The wall also extends from side to side of the base at an intermediate location thereon. The division wall has a base edge 28 which contacts the upper surface 14, a top edge 30, and front and back surfaces 32, 34, respectfully. The wall is connected to the base by L form brackets 36, or the like. At a central position, between sides 22 and 24 of the base, the division wall has a opening 38 formed therein. As seen in FIGS. 1 and 3, the opening 38 extends from the base edge 28 to a location spaced downwardly from the top edge 30, whereby a bridge section 40 of the division wall extends thereover.

A housing 42, formed of metal, plastic or other fluid impervious material is fixedly secured to the back surface 34 of the division wall. The housing is of unitary construction, and includes a pair of side walls 44, and back wall 46 with a curved upper portion 48. All of said walls 44 and 46 and the portion 48 have outward mounting flanges 50 by means of which they are affixed to the back surface 34 of the division wall, and to the upper surface 14 of the base, respectfully, in fluid tight relation thereto.

In order to further protect the base from fluid damage, and collect expended fluid for disposal or reuse, the invention is provided with a substantially rectangular collector tray 52 also formed of metal, plastic or other material adapted to convey liquids. The tray 52 is substantially flat, and is removably positioned principally within the housing 42. The tray 52 includes a base 54 which lies substantiall flush against the surface 14 of the base, and surrounding sides 56 which prevent spillage of liquid which gravitates thereinto.

A simulated aircraft in silhouette form 58 is affixed to the front surface 32 of the division wall on the bridge section 40 thereof immediately over the opening 38. The aircraft includes a bomb bay door representation 59 which extends down into the opening.

Figure 2:
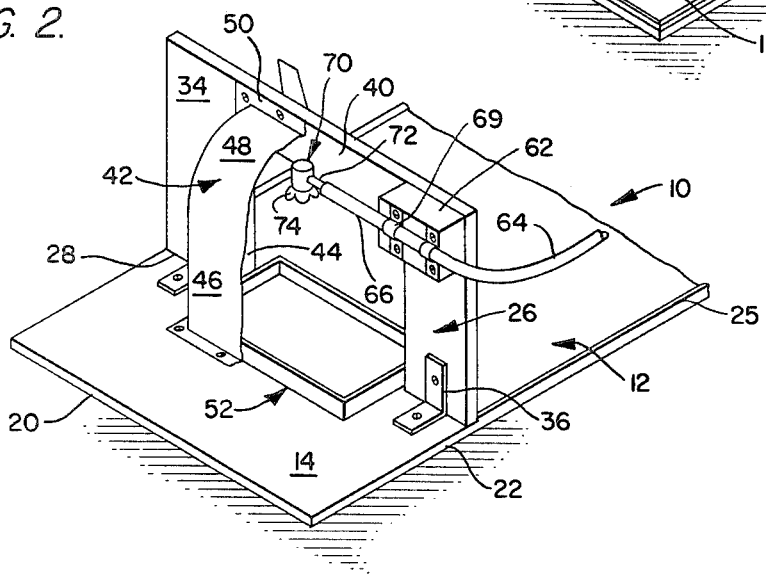
FIG. 2 is a partial rear perspective view.

Referring to FIG. 2, it will there be observed that an enlarged mounting block 62 is secured to the back surface 34 of the division wall adjacent the housing. An elongated flexible tube 64 has first and second end portions 66, 68, respectively, the first end portion 66 being secured to the block 62 by straps 69 and extending through an opening (not shown) in the adjacent wall 44 of the housing 42. The tube passes around the wall, and the second end portion 68 lies conveniently near the user of the device adjacent the front edge 18 of the base.

A conventional bubble pipe 70, having a stem 72 and bowl 74, is disposed within the housing. The bubble pipe 70 is demountably supported in inverted position behind the bridge section 40 and silhouette 58 by frictional engagement of the stem 72 within the first end portion 66 of the tube, with the bowl opening, whereat the bubble is formed, aligned behind the bomb bay door silhouette representation 59. A cup or other container 76 of bubble fluid is provided, on the base 12 at a convenient location for pipe access, and the pipe may be readily dismounted from the tube and dipped into the cup for recharging with bubble fluid when needed. When in mounted position, bubbles emitted from the bowl appear to emerge from the bomb bay door as air or smoke is blown into the second end of the tube.

A vertical bracket 78 is secured on the base at the front edge 18 thereof. A conventional water pistol 80 is secured thereon by a flexible band 82 which permits aiming of the pistol. By conventional pump action applied to the trigger mechanism of the pistol, or otherwise, a stream of water is directed from the pistol toward the housing. As bubbles are formed from the pipe bowl, contact by the stream from the pistol results in bursting thereof. Expended liquid from the pistol is discharged into the collector tray for disposal or reuse.

I claim:

1. An amusement device comprising:

a supporting base having a upper surface, front and back edges, and sides;

a vertically oriented division wall fixedly secured to the upper surface of the supporting base and extending from side to side thereof, the division wall having a base edge abuting said upper surface, a top edge, and front and back surfaces;

the division wall being located intermediate the front and back edges of the upper surface, and having a substantially central opening formed therein, the door extending from the base edge to a location spaced from the top edge, whereby a bridge section of the division wall extends over the opening;

a housing fixedly secured to the back surface of the division wall and to the upper surface of the supporting base about said opening, the housing having side walls and having a curved back wall, each of said walls having mounting flanges for effecting connection of said walls to the respective surfaces, in substantially fluid tight relation thereto;

a collector tray on the upper surface of the supporting base below the opening, the tray having vertical sides edges;

a simulated aircraft secured to the front surface of the division wall on the bridge section thereof, the aircraft including a simulated bomb bay door portion located immediately above the opening in the division wall;

a mounting block secured to the back surface of the division wall adjacent to housing, the housing side wall having an opening formed therein;

an elongated flexible tube, having first and second ends, the first end of the tube being secured in horizontal relation on the mounting block and extending through the opening in the housing side wall, and the tube extending around the division wall with the second end being disposed adjacent the front edge of the supporting base;

a bubble pipe having a bubble forming enlarged bowl portion, and a hollow stem, the stem being frictionally engaged demountably in the first end of the flexible tube to support the bubble pipe within the housing with the bowl in inverted position arranged to emit bubbles immediately below said simulated bomb bay door within said housing;

a vertical bracket secured on the base adjacent to front edge of the supporting base; and a water gun including a pump which emits upon actuation a stream of water which when aimed at bubbles emitted from the bubble pipe will rupture the same.

2. An amusement device comprising:

a supporting base;

wall means on said base intermediate two edges thereof and projecting vertically therefrom, said wall means having an opening therein;

a bubble forming device mounted on said wall means above said opening, the wall means being remote from one of the edges of the supporting base; and a device for emission of a fluid stream, said device being secured to supporting means attached to said supporting base and movable on said supporting means for aiming the fluid stream at bubbles formed at the bubble forming device, said formed bubbles projecting into said opening.

3. The invention of claim 2, and:

a tube for supplying air to form said bubbles, the tube being connected to the bubble forming device at one end thereof, the other end being positioned adjacent a user thereof who will blow air into said other end, said bubble forming device being demountably supported in inverted position on said wall means.

4. The invention of claim 2, and:

a collector tray on said base within said opening and removably mounted below said bubble-forming device, said collector tray having a base and surrounding side defining a shallow liquid collector.

5. The invention of claim 2, and: a housing secured to the wall means about the bubble forming device and said opening.

6. The invention of claim 5, and: a upward flange on said base terminating at said wall means.

* * * * *